US007831021B1

(12) United States Patent
Schumacher et al.

(10) Patent No.: US 7,831,021 B1
(45) Date of Patent: Nov. 9, 2010

(54) TARGET ASSEMBLY WITH ELECTRON AND PHOTON WINDOWS

(75) Inventors: Richard Schumacher, Sunnyvale, CA (US); David K. Jensen, Sunnyvale, CA (US); Maynard C. Harding, Menlo Park, CA (US); Randall D. Robinson, San Jose, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/551,059

(22) Filed: Aug. 31, 2009

(51) Int. Cl.
*H01J 35/08* (2006.01)

(52) U.S. Cl. ..... 378/143

(58) Field of Classification Search ..... 378/119, 378/143, 140, 144
See application file for complete search history.

(56) References Cited

U.S. PATENT DOCUMENTS

| | | | | |
|---|---|---|---|---|
| 4,048,496 | A * | 9/1977 | Albert | 378/45 |
| 4,425,506 | A | 1/1984 | Brown et al. | |
| 5,471,516 | A | 11/1995 | Nunan | |
| 5,680,433 | A | 10/1997 | Jensen | |
| 2007/0248215 | A1 * | 10/2007 | Ohshima et al. | 378/143 |

* cited by examiner

*Primary Examiner*—Courtney Thomas
(74) *Attorney, Agent, or Firm*—Houst Consulting

(57) ABSTRACT

An X-ray target assembly includes a substrate, a target supported by the substrate adapted to generate X-rays when impinged by an electron beam, and an enclosure over the target providing a volume for the target. The enclosure is made of a material substantially transparent to electrons. The volume is substantially vacuum or filled with an inert gas.

21 Claims, 3 Drawing Sheets

TARGET ASSEMBLY WITH ELECTRON AND PHOTON WINDOWS

BACKGROUND

This invention relates generally to X-ray apparatuses and in particular to X-ray target assemblies and X-ray apparatuses incorporating the same.

X-ray target assemblies are used for example in linear accelerators to produce X-rays, which have various applications including in medical radiation therapy and imaging. In operation, incident electron beams strike a target to generate X-rays. As a consequence, the target is heated to elevated temperatures. A target material oxidizes catastrophically at elevated temperatures, thus limiting its useful life. It would be therefore desirable to isolate the target from oxygen during operation.

In conventional linear accelerators, X-ray targets reside either within the vacuum envelope of an accelerator, or in air outside of the vacuum envelope. Target materials would be protected from oxidization if they reside within the vacuum envelope. However, the design for target assemblies residing within the accelerator vacuum envelope is complex due to added vacuum walls and interface considerations. Actuation of targets in vacuum is complicated and any water leaks in the assembly would contaminate the vacuum envelope causing extended downtime of the accelerator.

For target assemblies residing outside of the vacuum envelope, conventional methods for ensuring target longevity include reducing incident electron beam power. Target heating is modest and peak operating temperatures are below critical levels. However, the corresponding dose-rate output is limited due to the reduced beam power and temperature limits in the target materials. Another conventional method is to use oxidation resistant target materials such as gold, platinum, and their alloys. Conventional oxidation resistant materials generally have low strength, thus both the beam power used and corresponding dose rate are limited. In some conventional accelerators, the target assembly is moved during exposure to incident electron beams to reduce volumetric power deposition and peak operating temperatures.

Therefore, while significant achievements have been made, further developments are still needed to provide a target assembly capable of converting focused energetic electrons to ionizing radiation while protecting the heated portion of the target assembly from life-limiting oxidation corrosion.

SUMMARY

The X-ray target assemblies and linear accelerators incorporating the same provided by the present invention are particularly useful in medical radiation therapy, imaging, and other applications. In one embodiment, an X-ray target assembly includes a substrate, a target supported by the substrate adapted to generate X-rays when impinged by an electron beam, and an enclosure over the target providing a volume for the target. Preferably the enclosure is made of a material substantially transparent to electrons such as beryllium. In some embodiments, the volume is evacuated to remove oxygen. In some embodiments, the volume includes an inert gas.

In a preferred embodiment, the target assembly includes a second enclosure over a portion of the substrate under the target providing a second volume. The second enclosure is preferably made of a material substantially transparent to X-rays such as stainless steel. The second volume includes hydrogen or an inert gas.

The target assembly is particularly useful in producing X-rays with electron beams having an energy level ranging from 2 to 20 MV.

In a preferred embodiment, an X-ray target assembly comprises a substrate having a first side provided with a first recess, a target disposed in the first recess adapted to generate X-rays when impinged by an electron beam, and a first window over the first recess providing a first volume for the target. Preferably the substrate is further provided with a second recess on a second side under the target, and a second window over the second recess providing a second volume. In some preferred embodiments, the substrate is provided with a first passageway connecting the first volume to a source of vacuum or an inert gas, or the substrate is provided with a second passageway connecting the second volume to a source of vacuum or an inert gas.

In one aspect an x-ray apparatus comprises a first envelope of substantial vacuum, an electron source residing in the first envelope, a second envelope substantially purged of oxygen, and a target assembly residing in the second envelope. The target assembly comprises a substrate, and a target supported by the substrate adapted to generate X-rays when impinged by an electron beam from the electron source. The second envelope can be connected to a source of vacuum or an inert gas. A getter material may be disposed in the second envelope.

BRIEF DESCRIPTION OF THE DRAWINGS

These and various other features and advantages will become better understood upon reading of the following detailed description in conjunction with the accompanying drawings and the appended claims provided below, where:

DETAILED DESCRIPTION OF VARIOUS EMBODIMENTS

Various embodiments of target assemblies are described. It is to be understood that the invention is not limited to the particular embodiments described as such may, of course, vary. An aspect described in conjunction with a particular embodiment is not necessarily limited to that embodiment and can be practiced in any other embodiments. For instance, while various embodiments are described in connection with linear X-ray accelerators, it will be appreciated that the invention can also be practiced in other X-ray apparatuses and modalities. It is also to be understood that the terminology used herein is for the purpose of describing particular embodiments only, and is not intended to be limiting since the scope of the invention will be limited only by the appended claims, along with the full scope of equivalents to which such claims are entitled.

In addition, various embodiments are described with reference to the figures. It should be noted that the figures are not drawn to scale, and are only intended to facilitate the description of specific embodiments. They are not intended as an exhaustive description or as a limitation on the scope of the invention.

All technical and scientific terms used herein have the same meaning as commonly understood by one of ordinary skill in the art to which this invention belongs, unless defined otherwise. Various relative terms are used in the description and appended claims such as "on," "upper," "above," "over," "under," "top," "bottom," "higher," and "lower" etc. These relative terms are defined with respect to the conventional plane or surface being on the top surface of the structure, regardless of the orientation of the structure, and do not necessarily represent an orientation used during manufacture or use. The following detailed description is, therefore, not to be taken in a limiting sense. As used in the description and appended claims, the singular forms of "a," "an," and "the" include plural references unless the context clearly dictates otherwise.

Figure 1:
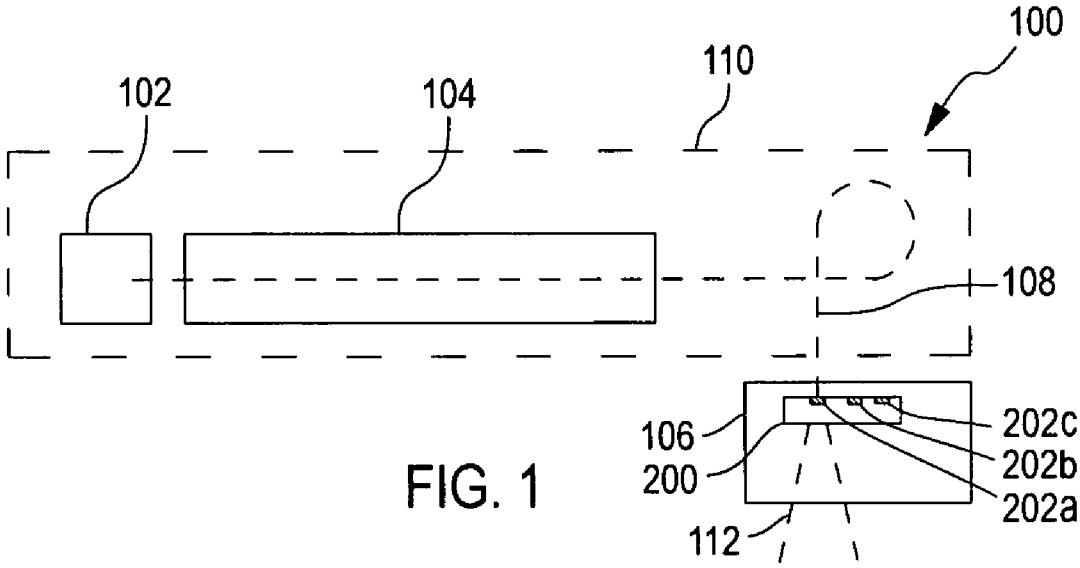
FIG. 1 is a schematic diagram illustrating a linear accelerator including a target assembly in accordance with some embodiments of the invention.

FIG. 1 is a schematic diagram illustrating a linear accelerator 100 that includes a target assembly 200 in accordance with some embodiments of the invention. The accelerator 100 includes an electron gun 102, an accelerator guide 104, and a treatment head 106 housing various components configured to produce, shape or monitor a treatment beam. A target assembly 200 is located in the treatment head 106. For simplicity of description, some accelerator components are not shown in FIG. 1. The electron gun 102 produces and injects electrons into the accelerator guide 104, which modulates the electrons to a desired energy level e.g. a Mega voltage level by using pulsed microwave energies. An electron beam 108 exits the accelerator guide 104 and is directed to the target assembly 200. An optional bending magnet may be used to turn the electron beam 108 for example by approximately 90° to 270° before the beam strikes the target assembly 200. A vacuum envelope 110 provides vacuum for operation of the electron gun 102, accelerator guide 104, and other components (not shown). The target assembly 200 preferably resides outside the accelerator vacuum envelope 110 although it can reside within the vacuum envelope 110. Alternatively, the target assembly 200 may reside within a separate vacuum envelope (not shown) independent of the accelerator vacuum envelope 110. An electron beam 108 strikes a target 202 and X-rays 112 are produced. The produced X-rays are defined or shaped by additional devices (not shown) to provide a controlled profile or field of a treatment beam suitable for radiation therapy, imaging, or other applications.

The target assembly 200 may include one or more targets each being optimized to match the energy of an incident electron beam. For example, the target assembly 200 may include a first target 202*a* adapted for a first photon mode, a second target 202*b* for a second photon mode, and a third target 202*c* for a third photon mode. The material of a target can be chosen and/or the thickness of a target be optimized to match the energy level of a particular incident electron beam. By way of example, the first target 202*a* can be optimized for an incident electron beam having an energy level ranging from 4 to 6 MV. The second target 202*b* can be optimized for an incident electron beam having an energy level ranging from 8 to 10 MV. The third target 202*c* can be optimized for an incident electron beam having an energy level ranging from 15 to 20 MV. It should be noted that while three targets are illustrated and described, a different number of targets may be included in the target assembly 200.

The target assembly 200 is movable to switch between different photon modes or between a photon mode and an electron mode. For example, the target assembly 200 may be coupled to a servo motor (not shown) which is operable to move the target assembly 200 in a linear direction. The servo motor drives the target assembly 200 to position a correct target 202 in the beam path for a photon mode, or move the target out of the beam path for an electron mode. Preferably the servo motor is electrically connected to a computer and operable with user interface software.

Figure 2A:
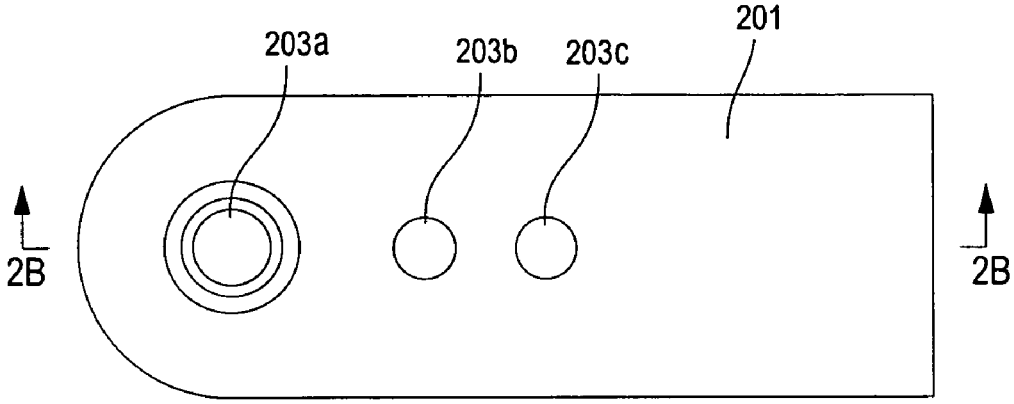
FIG. 2A is a top plan view of a substrate of a target assembly in accordance with some embodiments of the invention.
Figure 2B:
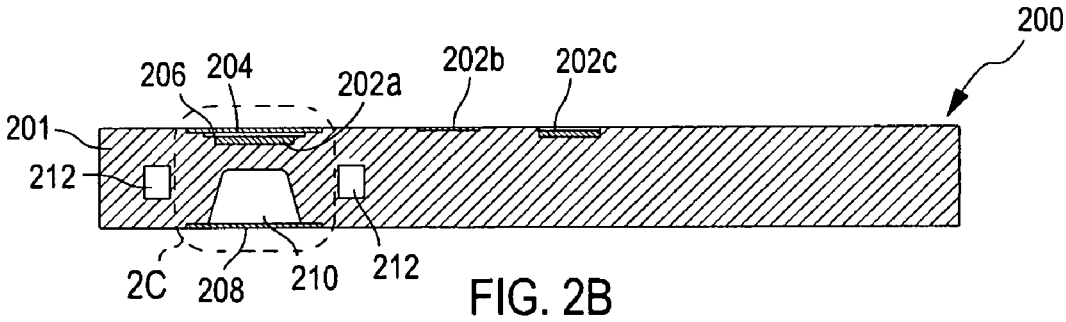
FIG. 2B is a cross-sectional view of a target assembly in accordance with some embodiments of the invention.
Figure 2C:
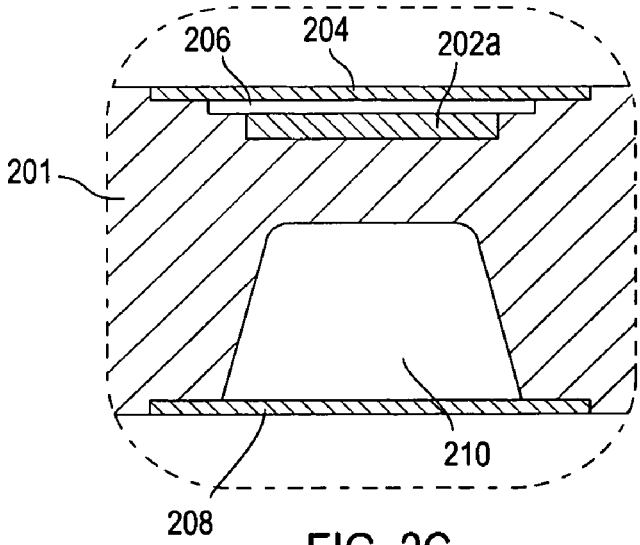
FIG. 2C is an enlarged, partial cross-sectional view illustrating an electron window over a target and a photon window over a portion of the substrate.
Figure 3A:
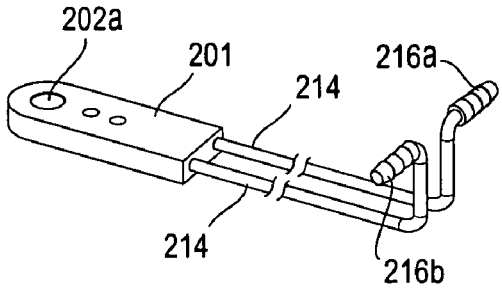
FIG. 3A is a perspective view of a target assembly including a substrate supporting one or more targets and cooling tubes coupled to the substrate.
Figure 3B:
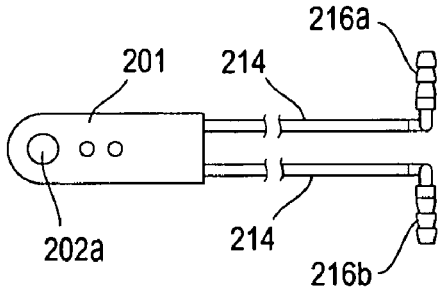
FIG. 3B is a top plan view of the target assembly illustrated in FIG. 3A.

Referring to FIGS. 2-3, an exemplary target assembly 200 includes a substrate 201, and one or more targets 202*a*, 202*b*, 202*c* supported by the substrate 201 at one or more locations. The substrate 201 can be a piece of copper or any suitable metals that can efficiently conduct and dissipate heat generated during operation. The target 202*a*, 202*b*, or 202*c* can be a piece of tungsten or any other metallic material that is capable of producing X-rays when impinged by energetic electrons. At least one of the target locations e.g. at the location supporting target 202*a*, a first window or enclosure 204 is provided over the target to provide a first volume of protective atmosphere or environment 206 for the target. A second window or enclosure 208 may be provided over a portion of the substrate 201 under the target 202*a* to provide a second volume of protective atmosphere or environment 210.

At one or more of the target locations, recesses may be provided for holding one or more targets in place. FIG. 2A shows recesses 203*a*, 203*b*, 203*c* for receiving targets 202*a*, 202*b*, 202*c*, respectively. The recesses may be in various configurations such as circles, squares and other regular or irregular configurations. The targets can be in any regular or irregular shapes to match the recess configurations. In some embodiments, a recess may be stepped. For example, a target e.g. 202*a* can be placed in the bottom of recess 203*a* and fixed to the substrate 201 by brazing or other suitable means. A first window 204 can be disposed on a recess step, forming a gap between the target 202*a* and the first window 204. The first window 204 can be fixed to the substrate 201 e.g. by brazing or other suitable means. The first window 204 and a side wall of recess 203*a* define a first volume 206 for the target 202*a*. The protective atmosphere or environment may be vacuum or an inert gas such as argon, nitrogen etc. For example, a vacuum may be created in the first volume 206 during a brazing operation of the first window 204 in a vacuum furnace. The first volume of protective atmosphere 206 isolates the target 202*a*, or prevents oxygen from reaching the target 202*a*, thus preventing oxidization of the target 202*a* at elevated temperatures.

The first window 204 or at least a portion of the first window 204 facing the incident electron beam is preferably substantially transparent to electrons (electron window) such that a substantial amount of the incident electrons pass through the first window to strike the target 202*a* to generate a usable x-ray beam. By way of example, the first window 204 may be a beryllium disk. Other metallic materials that are substantially transparent to electron beams may also be used for the first window 204. The thickness of the first window can be e.g. from 0.12 to 0.50 mm.

In some embodiments, a second volume of protective atmosphere or environment may be provided for a target. For example, recesses may be created in substrate portions under target 202*a*, 202*b*, or near target 202*c*. A second window 208 encloses the recess e.g. under target 202*a* to form a second volume of protective atmosphere or environment 210 for the target 202*a*. In the prior target assemblies, fatigue cracks can propagate from an exposed substrate surface to the target-substrate interface, allowing oxygen to reach the target from its backside. When this occurs, catastrophic oxidation of the target occurs. The second window 208 or volume 210 isolates the critical portion of the substrate under the target 202*a*, or prevents oxygen from reaching the target 202*a* from its backside. Thus, the second window 208 or second volume 210 prevents oxidation of the target should fatigue failure of the substrate ocurr, extending the useful life of the target.

The second window 208 is preferably substantially transparent to X-rays (photon window). Suitable materials for the second window 208 include stainless steel or other suitable materials of low X-ray attenuation. The thickness of the second window 208 may be small or optimized to minimize X-ray attenuation. By way of example, a stainless steel window 208 may have a thickness ranging from 0.12 to 0.25 mm. The stainless steel window 208 may be fixed to the substrate 201 by a brazing operation in a hydrogen furnace to create a volume of hydrogen. Other suitable protective environment in the second volume 210 includes vacuum or inert gases.

Channels 212 may be provided in the substrate 201 adjacent or surrounding the targets to provide passageways for cooling fluid such as water or the like to dissipate heat generated during operation. Cooling fluid may be introduced into and removed from the channels 212 by a cooling tube 214 via an inlet 216*a* and outlet 216*b*. A continuous flow of a cooling fluid into and out of the channels 212 allows the target assembly to be continuously cooled during operation.

Figure 4:
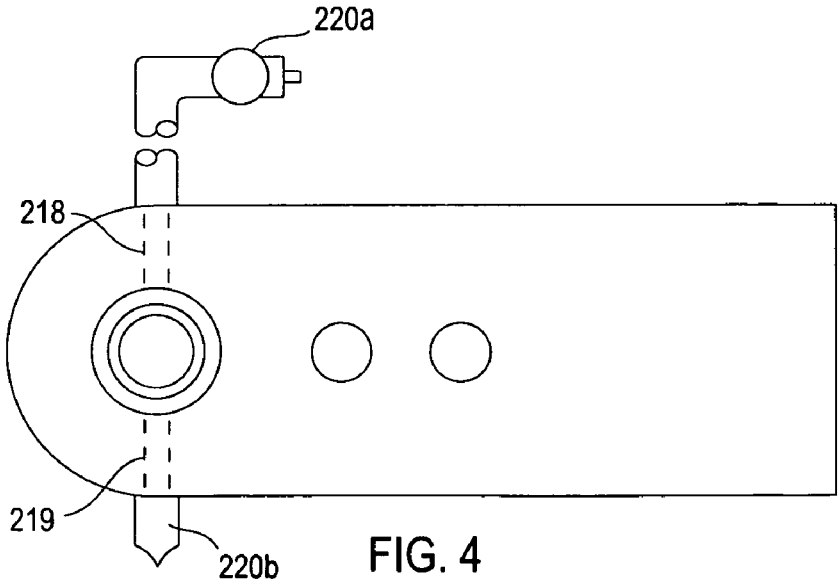
FIG. 4 is top plan view of a target assembly in accordance with some embodiments of the invention.

In some embodiments illustrated in FIG. 4, channels 218 and/or 219 may be provided to connect the first volume 206 and/or second volume 210 to a vacuum source, an inert gas source, or a pump 220*a*. A vacuum purge followed by a pinch-off 220*b* or active pumping e.g. with a vac-ion pump 220*a* would preserve the vacuum in the first or second volume. In some embodiments, getters may be disposed in the first and/or second volumes to maintain the vacuum of the volumes. In some embodiments, the channel 218 or 219 would allow an inert gas to be backfilled into the first or second volume to preserve the protective atmosphere.

Exemplary embodiments of target assemblies have been described. The target assembly advantageously employs an electron window and/or a photon window to provide a protective atmosphere or environment in a volume that isolates the target or prevents oxygen from reaching the target from its front side or backside. The volume may be purged using e.g. a vacuum pump or backfilled with an inert gas to preserve the protective environment. This isolation prevents catastrophic oxidation of the target at elevated temperatures and thus prolongs the useful life of the target. As a result, the target assembly may advantageously reside outside of the accelerator vacuum envelope and thus allow its design to be simplified. Alternatively, the target assembly may be enclosed in a separate envelope that is independent of the accelerator vacuum envelope. The separate envelope may be purged using e.g. a vacuum pump or backfilled with an inert gas, or contain a getter material to preserve a protective environment as described above. In some alternative embodiments, a target gas system may be employed in which a compressed inert gas is directed across the target surface during operation to provide protective atmosphere. The target surface may also be treated with a thin coating of oxidation resistant material to provide a protective layer during operation, in which case full or partial enclosure of the target would not be required. Those skilled in the art will appreciate that various other modifications may be made within the spirit and scope of the invention. All these or other variations and modifications are contemplated by the inventors and within the scope of the invention.

What is claimed is:

1. An X-ray target assembly comprising:

a substrate;

a target supported by the substrate adapted to generate X-rays when impinged by an electron beam; and an enclosure over the target, said enclosure and a portion of said substrate forming a volume for the target; wherein said volume possesses substantially no oxygen.

2. The X-ray target assembly of claim 1 wherein at least a portion of said enclosure is made of a material substantially transparent to electrons.

3. The X-ray target assembly of claim 1 wherein said enclosure comprises a window made of beryllium.

4. An X-ray target assembly comprising:

a substrate;

a target supported by the substrate adapted to generate X-rays when impinged by an electron beam; and an enclosure over the target, said enclosure and a portion of said substrate forming a volume for the target;

wherein said volume includes an inert gas.

5. The X-ray target assembly of claim 1 further comprising a second enclosure over a portion of the substrate under the target providing a second volume.

6. An X-ray target assembly comprising:

a substrate;

a target supported by the substrate adapted to generate X-rays when impinged by an electron beam;

a first enclosure over the target, said enclosure and a portion of said substrate forming a volume for the target; and a second enclosure over a portion of the substrate under the target providing a second volume;

wherein the second enclosure is made of a material substantially transparent to X-rays.

7. The X-ray target assembly of claim 6 wherein the second enclosure comprises a window made of stainless steel.

8. An X-ray target assembly comprising:

a substrate;

a target supported by the substrate adapted to generate X-rays when impinged by an electron beam;

a first enclosure over the target, said enclosure and a portion of said substrate forming a volume for the target; and a second enclosure over a portion of the substrate under the target providing a second volume;

wherein said second volume includes hydrogen.

9. The X-ray target assembly of claim 1 wherein said target is adapted to generate X-rays when impinged by an electron beam having an energy level ranging from 4 to 6 MV.

10. An X-ray target assembly comprising:

a substrate having a first side and an opposite second side, the substrate being provided with a first recess on the first side of the substrate;

a target disposed in the first recess adapted to generate X-rays when impinged by an electron beam; and a first window over the first recess providing a first volume for the target.

11. The X-ray target assembly of claim 10 wherein said first window comprises beryllium.

12. The X-ray target assembly of claim 10 wherein the substrate is provided with a second recess on the second side of the substrate under the target, and a second window over the second recess providing a second volume.

13. The X-ray target assembly of claim 12 wherein said second window comprises stainless steel.

14. The X-ray target assembly of claim 10 wherein said target is adapted to generate X-rays when impinged by an electron beam having an energy level ranging from 4 to 6 MV.

15. The X-ray target assembly of claim 10 wherein said substrate is provided with a first passageway connecting the first volume to a source of vacuum or an inert gas.

16. The X-ray target assembly of claim 15 wherein the substrate is provided with a second passageway connecting the second volume to a source of vacuum or an inert gas.

17. An X-ray apparatus comprising:

a first envelope of substantial vacuum;

an electron source residing in the first envelope;

a second envelope substantially purged of oxygen; and a target assembly residing in the second envelope, said target assembly comprising a substrate, and a target supported by the substrate adapted to generate X-rays when impinged by an electron beam from the electron source.

18. The X-ray apparatus of claim 17 wherein said second envelope is connected to a source of vacuum or an inert gas.

19. The X-ray apparatus of claim 17 further comprising a getter material in the second envelope.

20. An X-ray target assembly comprising:

a substrate; and a target supported by the substrate adapted to generate X-rays when impinged by an electron beam, wherein said target comprises a protective layer comprising an oxidation resistant material;

wherein said substrate is provided with a recess, and said target is disposed in the recess.

21. An X-ray apparatus comprising:

an envelope of substantial vacuum;

an electron source residing in the envelope; and a target assembly comprising a substrate and a target supported by the substrate adapted to generate X-rays when impinged by an electron beam from the electron source, said target comprising a protective layer comprising an oxidation resistant material;

wherein said target assembly resides outside the envelope.

* * * * *